US007116346B2

(12) United States Patent
Lassen et al.

(10) Patent No.: US 7,116,346 B2
(45) Date of Patent: Oct. 3, 2006

(54) DEVICE FOR SETTING THE FOCUS OF EXPOSURE HEADS OF A PRINTING PLATE EXPOSER

(75) Inventors: Bernd Lassen, Mönkeberg (DE); Dirk Ingmar Nitsch, Kiel (DE); Burkhard Paasch, Wahlstorf (DE); Lars Paulsen, Hollingstedt (DE); Stefan Schmidt, Kiel (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 237 days.

(21) Appl. No.: 10/728,386

(22) Filed: Dec. 5, 2003

(65) Prior Publication Data

US 2004/0207711 A1 Oct. 21, 2004

(30) Foreign Application Priority Data

Mar. 6, 2003 (DE) ..... 103 09 772

(51) Int. Cl.
*B41J 27/00* (2006.01)

(52) U.S. Cl. ..... 347/242; 347/257

(58) Field of Classification Search ..... 347/5, 347/8, 19, 32, 197–198, 220, 263, 241–245, 347/254, 256–258; 101/87, 93.36; 400/55–60, 400/124.27, 124.31, 168, 326, 464–465, 400/681

See application file for complete search history.

(56) References Cited

U.S. PATENT DOCUMENTS 6,042,217 A * 3/2000 Jones ..... 347/32
6,559,880 B1 * 5/2003 Ohba ..... 347/263
6,662,720 B1 12/2003 Schmid ..... 101/216

FOREIGN PATENT DOCUMENTS

DE 198 48 455 A1 4/2000
EP 0 164 764 A2 12/1985
JP 06270500 A * 9/1994

* cited by examiner

*Primary Examiner*—Hai Pham
(74) *Attorney, Agent, or Firm*—Laurence A. Greenberg; Werner H. Stemer; Ralph E. Locher

(57) ABSTRACT

A device sets the focus of at least one exposure head on a recording material, in particular a printing plate, in an exposer for recording printing originals. An exposer has an exposure drum for holding the printing plates, and an exposure-head carrier, which contains a carrier plate for holding exposure heads, and a carrier base. The carrier plate and the carrier base are connected such that they can move by a hinge which is disposed on the front side of the exposure-head carrier, facing the exposure drum. The rear of the carrier plate is raised or lowered by a tilting drive, as a result of which the exposure heads are moved jointly and substantially radially toward the exposure drum or away from the exposure drum. The hinge is preferably formed from at least one spring plate.

8 Claims, 3 Drawing Sheets

DEVICE FOR SETTING THE FOCUS OF EXPOSURE HEADS OF A PRINTING PLATE EXPOSER

BACKGROUND OF THE INVENTION

Field of the Invention

The invention relates to the field of electronic reproduction technology and pertains to a device for setting the focus of exposure heads in an exposer for recording printing originals on printing plates.

In reproduction technology, printing originals for printed pages that contain all the elements to be printed such as texts, graphics and images are produced. For color printing, a separate printing original is produced for each printing ink and contains all the elements that are printed in the respective color. For four-color printing, these are the printing inks cyan, magenta, yellow and black (CMYK). The printing originals separated in accordance with printing inks are also referred to as color separations. The printing originals are generally screened and, by using an exposer, are exposed onto films, with which printing plates for printing large editions are then produced. Alternatively, the printing originals can also be exposed directly onto printing plates in special exposure devices, or they are digital data to a digital printing press. There, the printing-original data is then exposed onto printing plates, for example with an exposing unit integrated into the printing press, before the printing of the edition begins immediately thereafter.

According to the current prior art, the printing originals are reproduced electronically. In this case, the images are scanned in a color scanner and stored in the form of digital data. Texts are generated with text processing programs and graphics with drawing programs. Using a layout program, the image, text and graphic elements are assembled to form a printed page. The data for several printed pages is combined with the data for other elements, such as register crosses, cut marks and fold marks as well as print control fields, to form printing originals. The data formats largely used nowadays to describe the printing originals are the page description languages PostScript and portable document format (PDF). In a first step, the PostScript or PDF data is converted in a raster image processor (RIP) into the rastered color separations CMYK before the recording of the printing originals.

In the recording devices which are used in electronic production technology for the exposure of printing originals and printing forms, for example a laser beam is produced by a laser diode, shaped by an optical device and focused on to the recording material and deflected over the recording material point by point and line by line by a deflection system. There are also recording devices which, in order to increase the exposure speed, produce one or more bundles of laser beams, for example with one or more laser diode arrays, and expose a plurality of image lines of the printing form simultaneously each time they sweep across the recording material. The recording material can be located on a drum (external drum exposer), in a cylindrical hollow (internal drum exposer) or on a flat surface (flatbed exposer). In the case of an external drum exposer, the material to be exposed, in the form of films or printing plates, is mounted on a drum such that it can rotate. While the drum rotates, an exposure head is moved axially along the drum at a relatively short distance. The exposure head focuses one or more laser beams onto the drum surface, sweeping over the drum surface in the form of a narrow helix.

The depth of focus range of a laser beam in an external drum exposer for printing plates is about 0.1 mm. Since the printing plates can have different plate thicknesses, for example in the range from 0.1 to 0.3 mm, a device is necessary with which the focus of the laser beams can be set to match the thickness of the printing plates. Known devices for this purpose, with which the optical image of the laser beams is adjusted or with which the exposure head which produces the laser beams is displaced radially toward the exposure drum or away from it are complicated in constructional terms and associated with high costs. This applies in particular if the printing plate is to be exposed simultaneously with many laser beams or with a plurality of exposure heads.

SUMMARY OF THE INVENTION

It is accordingly an object of the invention to provide a device for setting the focus of exposure heads of a printing plate exposer that overcomes the above-mentioned disadvantages of the prior art devices of this general type, which is cost-effective, simple and reliable for setting the focus of the laser beams in an exposer for recording printing originals on printing plates.

With the foregoing and other objects in view there is provided, in accordance with the invention, a device for setting a focus of exposure heads on a recording material in an exposer for recording printing originals. The device contains an exposure-head carrier having a carrier plate for holding the exposure heads, a carrier base, and a hinge connecting the carrier plate and the carrier base such that they can move.

The object is achieved by a device with which the exposure-head carrier, on which a plurality of exposure heads can be disposed and with which the exposure heads are moved jointly and axially along the exposure drum, carries out a tilting movement. As a result of the tilting movement, all the exposure heads are moved radially toward the exposure drum or away from it at once by the same amount.

In accordance with an added feature of the invention, the exposure-head carrier has a front side facing the exposure drum and the hinge is disposed on the front side. The exposure-head carrier further has a tilting drive with which a rear of the carrier plate facing the exposure drum can be raised or lowered. Carrier arms are connected to the rear of the carrier plate and a rotatably driven eccentric shaft is connected to the carrier arms and to the rear of the carrier plate through the carrier arms. By a tilting movement of the carrier plate, the exposure heads can be moved jointly and substantially radially toward the exposer or away from the exposer.

In accordance with another feature of the invention, the hinge is formed of at least one spring plate.

In accordance with a further feature of the invention, the recording material is a printing plate and the exposer is an external drum exposer with an exposure drum for holding the printing plate.

Other features which are considered as characteristic for the invention are set forth in the appended claims.

Although the invention is illustrated and described herein as embodied in a device for setting the focus of exposure heads of a printing plate exposer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
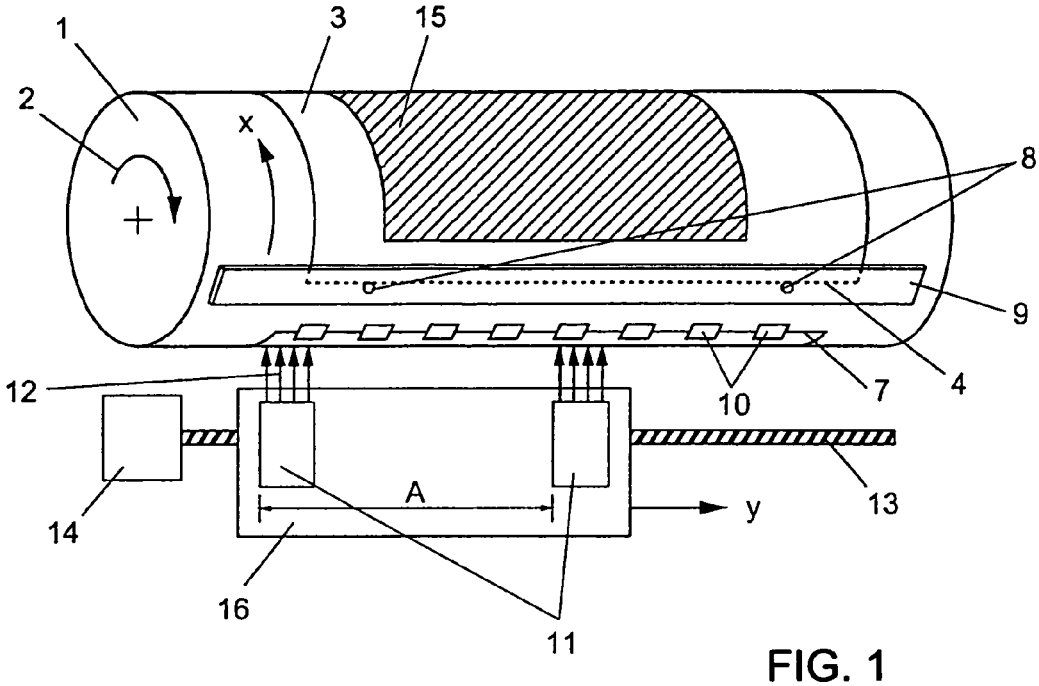
FIG. 1 is a diagrammatic, perspective view of an external drum exposer.

Referring now to the figures of the drawing in detail and first, particularly, to FIG. 1 thereof, there is shown the basic construction of an external drum exposer. An exposer drum 1 is mounted such that it can rotate and can be set into a uniform rotational movement in a direction of rotation arrow 2 by a non-illustrated rotational drive. Clamped to the exposure drum 1 is an unexposed, rectangular printing plate 3. The printing plate 3 is clamped on in such a way that its leading edge 4 touches contact pins 8 which are firmly connected to the exposure drum 1 and project beyond the surface of the exposure drum 1. A clamping strip 9 presses the leading edge 4 firmly on to the surface of the exposure drum 1 as well and, as a result, fixes the leading edge 4 of the printing plate 3. The printing plate 3 is held flat on the drum surface by a vacuum device, not shown in FIG. 2, which attracts the printing plate 3 by suction through holes in the drum surface, in order that the printing plate 3 is not loosened by the centrifugal forces during the rotation. Additionally, a trailing edge 7 of the printing plate 3 is prevented from lifting off the exposure drum 1 by limiting pieces 10.

An exposure head 11 or else a plurality of exposure heads 11 which are disposed on a common exposure-head carrier 16 are moved axially along the exposure drum 1 at a relatively short distance as the exposure drum 1 rotates. Each exposure head 11 focuses one or more laser beams 12 onto the drum surface, which sweep over the drum surface in the form of narrow helices. In this way, during the drum revolution, one or more groups of image lines are exposed onto the recording material in a circumferential direction x. The exposure-head carrier 16 is moved in a feed direction y by a feed spindle 13, to which it is connected by a form fit and which is set moving rotationally by a feed drive 14.

As a result of using a plurality of exposure heads 11, the productivity is increased, that is to say the printing plate 3 can be exposed in a shorter time. FIG. 1 shows, as an example, an exposer with two exposure heads 11, which are disposed at a distance A in the axial direction and in each case focus a bundle of laser beams 12 onto the printing plate 3. As a result, a printing original 15 is exposed simultaneously by two groups of helices, which sweep over the drum surface at the axial distance A.

Figure 2:
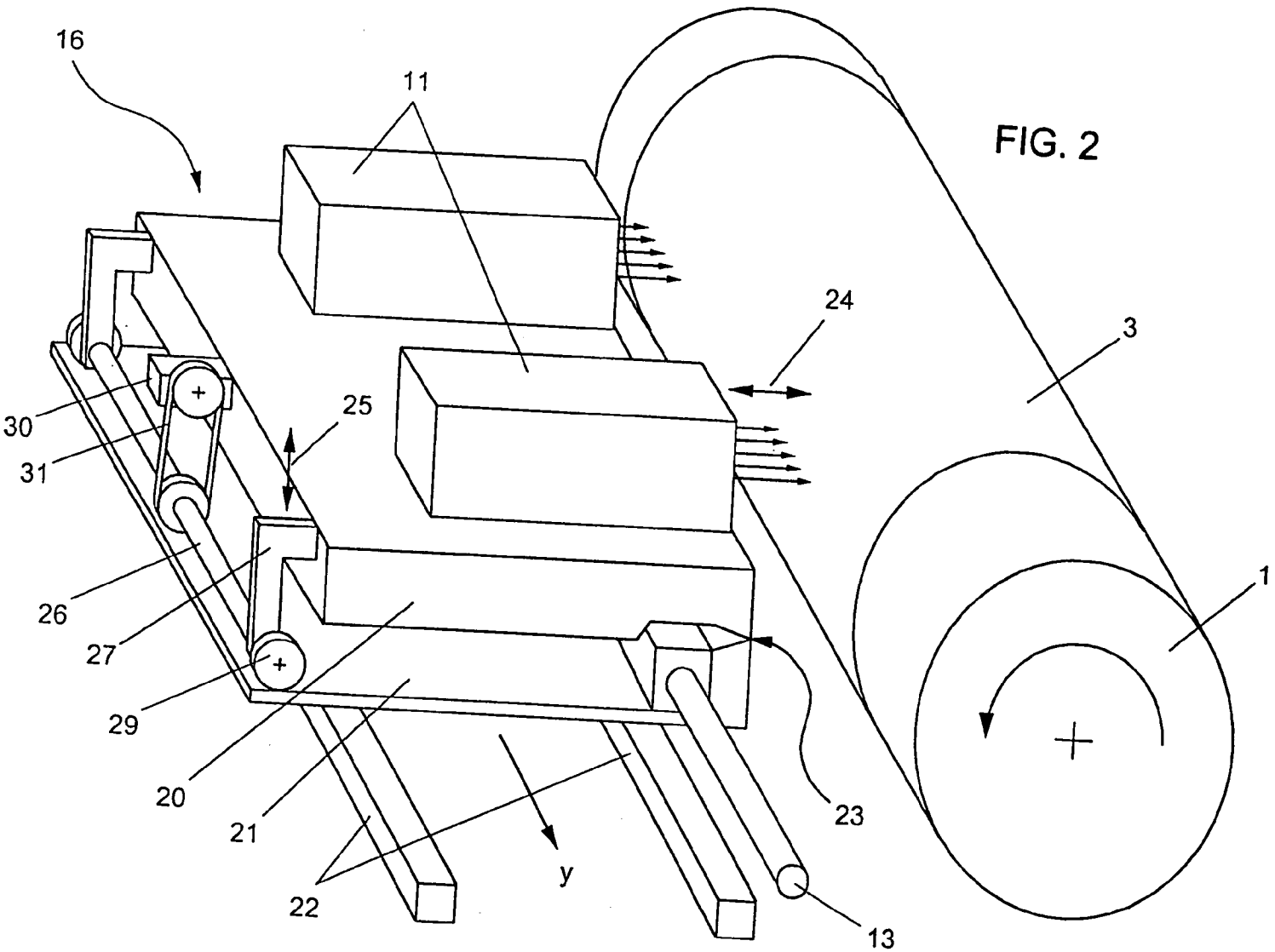
FIG. 2 is a diagrammatic, perspective view of a tilting device for an exposure-head carrier according to the invention.

FIG. 2 shows a device according to the invention for setting the focus of the exposure heads 11 in a perspective view. The exposure-head carrier 16 contains two parts, a carrier plate 20 on which the exposure heads 11 are mounted, and a carrier base 21, which runs on guide rails 22 and, by the feed spindle 13, is moved axially along the exposure drum 1 in the y direction together with the carrier plate 20. On the side facing the exposure drum 1, the carrier plate 20 and the carrier base 21 are connected by a hinge 23 whose axis of rotation extends in the y direction. The hinge 23 permits a tilting movement of the carrier plate 20 about the axis of rotation of the hinge 23, as a result of which the exposure heads 11 mounted on the carrier plate 20 can be moved toward the exposure drum 1 or away from the exposure drum 1 in the direction of arrow 24. The tilting movement of the carrier plate 20 is carried out, for example, by a drive which raises or lowers the rear side of the carrier plate 20, facing away from the exposure drum 1, in the direction of arrow 25. As a result of the tilting movement, the focus of the laser beams 12 for all the exposure heads 11 is set optimally to the respective thickness of the printing plate 3 to be exposed, before the start of the exposure.

Figure 3A:
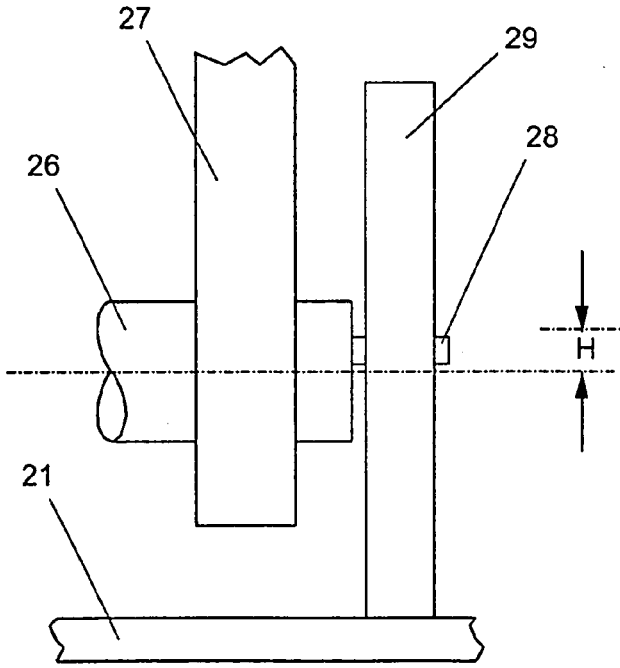
FIGS. 3A and 3B are partial, side-elevational views of a tilting drive with an eccentric shaft.
Figure 3B:
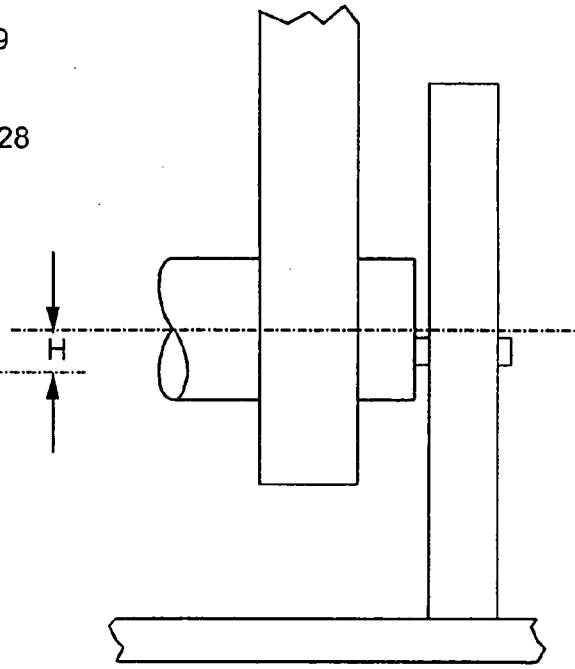

Various configurations can be used as a drive for the tilting movements. FIG. 2 shows a preferred embodiment of the drive. An eccentric shaft 26 is connected to a rear of the carrier plate 20 by carrier arms 27. The eccentric shaft 26 is rotatably mounted in the carrier arms 27. At both ends, the eccentric shaft 26 in each case has an eccentrically disposed journal 28, which in each case bears a roller 29 which rolls on the carrier base 21. FIGS. 3A and FIG. 3B show this for one end of the eccentric shaft in an enlarged view. If the eccentric shaft 26 is rotated through a specific angle, it is raised or lowered by the eccentric journals 28. Therefore, the carrier arms 27 are also raised or lowered, as a result of which the carrier plate 20 is tilted about the axis of the hinge 23. FIG. 3A shows the eccentric shaft 26 in its lowest position, and FIG. 3B shows it in its highest position. A height difference H is dimensioned such that the exposure heads 11 can be adjusted radially with respect to the exposure drum 1 over a sufficiently large range, taking into account the lever lengths on the two sides of the axis of the hinge 23.

The rotary drive for the eccentric shaft 26 is provided, for example, by a stepping motor 30 via a toothed belt 31 (FIG. 2). The eccentric shaft 26 is also expediently further connected to a non-illustrated device for determining a zero-angle position of the eccentric shaft 26, which, for example, can contain a disk provided with a slit and a light barrier. The zero-angle detector can be adjusted in such a way that the exposure heads 11 are located in a central position of the radial feed range at the zero-angle position of the eccentric shaft 26. The requisite radial feed range is, for example, 0.5 mm, and the feeding of the exposure heads 11 must be carried out reproducibly in very small steps. By rotating the eccentric shaft 26 by a specific number of clock cycle steps of the stepping motor 30, the exposure heads 11 are then moved toward the exposure drum 1 or away from it by an exactly defined distance, depending on the direction of rotation. The necessary number of clock cycle steps can be calculated in advance from the lever relationships of the tilting drive. Alternatively, the radial feed can be measured once as a function of the number of clock cycle steps and stored in a look-up table of the exposer, from where they can be made available later as setting values during the operation of the exposer. Therefore, at the same time all the mechanical tolerances of the tilting drive are registered and taken into account. Because of the tilting movement about the axis of the hinge 23, the exposure heads 11 do not move on a straight line radially with respect to the exposure drum 1 but on part of a circular arc. As a result, the points at which the laser beams 12 strike the printing plate 3 are displaced somewhat in the circumferential direction of the exposure drum 1.

However, this displacement can be compensated for by an appropriate displacement of the time cycles at which the exposure of the image lines begins, so that, for each possible radial feed setting of the exposure heads 11, the exposure of the printing originals always begins at the same distance from the leading edge 4 of the printing plate 3.

Figure 4:
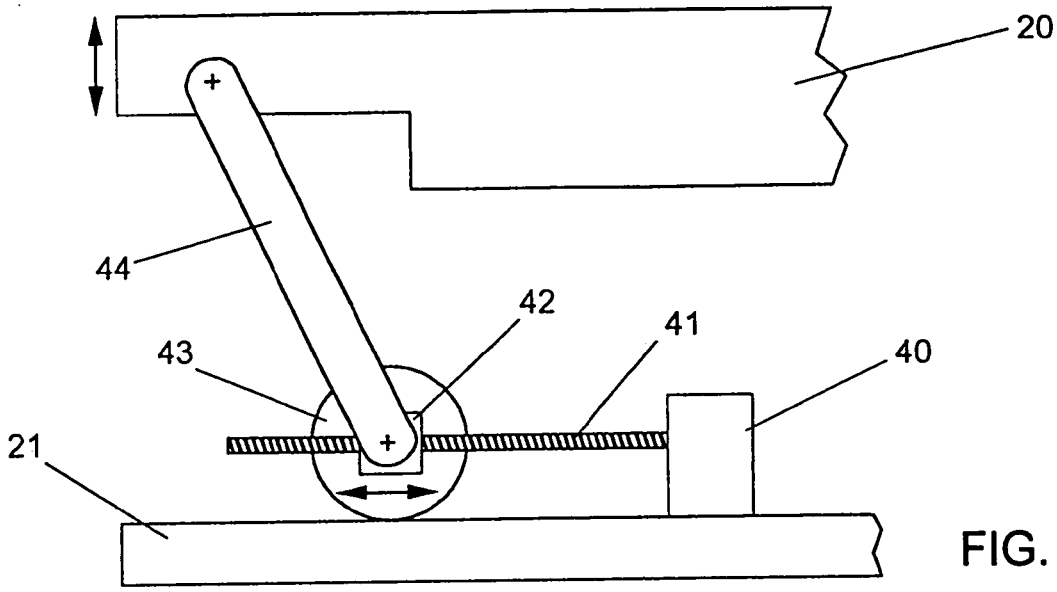
FIG. 4 is an illustration of the tilting drive with a tilting lever.

FIG. 4 shows an alternative embodiment of the tilting drive. Mounted on the carrier base 21 is a stepping motor 40 that drives a traction spindle 41 in rotation. A nut segment 42 engages with a form fit in the traction spindle 41, so that the nut segment 42 can be moved horizontally to and from during rotation of the traction spindle 41. Fixed to the nut segment 42 is a roller 43 that rolls on the carrier base 21 during the horizontal movement of the nut segment 42. In addition, a tilting lever 44 is rotatably mounted on the nut segment 42, its other end being rotatably connected to the rear of the carrier plate 20. The length of the tilting lever 44 is dimensioned such that the horizontal movement of the nut segment 42 is converted into a vertical movement of the rear of the carrier plate 20.

Figure 5:
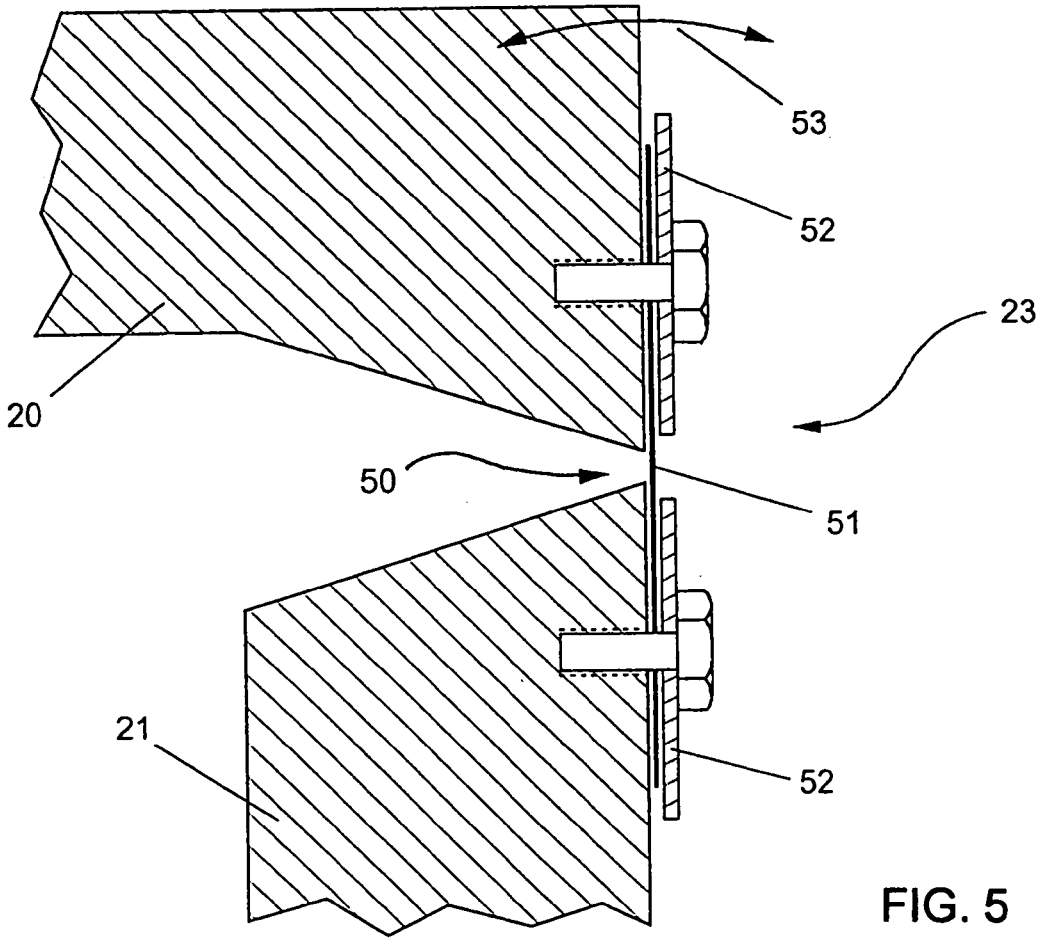
FIG. 5 is a diagrammatic, sectional view of a hinge with a spring plate.

FIG. 5 shows a preferred embodiment of the hinge 23 in an enlarged cross-sectional view of the end of the exposure-head carrier 16. The carrier plate 20 and the carrier base 21 are separated by a narrow gap 50 on their side facing the exposure drum 1. Placed over the gap 50 is a spring plate 51, which is clamped firmly to the carrier plate 20 and to the carrier base 21 by two clamping rails 52 and screws. During the tilting movement of the carrier plate 20 in the direction of the arrow 53, the spring plate 51 in the gap 50 is bent. The spring plate 51 is formed of a resilient material, preferably of spring steel. Since the tilting angle is only a fraction of a degree, the bending stress is very low. The spring plate 51 can be configured such that it extends over the entire axial length of the exposure-head carrier 16. However, it is more advantageous to provide a plurality of spring plates 51 over the axial length of the exposure-head carrier 16, in order to continue to maintain the function of the hinge 23 even if a spring plate 51 should break. Other constructional configurations of the hinge 23 are likewise conceivable. Because of the requisite accuracy and reproducibility of the radial freedom movement of the exposure heads 11, the hinge 23 must operate without play.

We claim:

1. An assembly in an exposer with an exposure drum for recording printing originals on a recording material, the assembly comprising:

exposure heads for focusing laser beams on the recording material;

a device for setting a focus of said exposure heads on the recording material, the device having:

an exposure-head carrier having a carrier plate for holding said exposure heads, a carrier base, and a hinge connecting said carrier plate and said carrier base such that they can move, said hinge having a fixed axis of rotation extending axially along the exposure drum and said hinge permitting a tilting movement of said carrier plate about said axis of rotation.

2. The assembly according to claim 1, wherein said exposure-head carrier has a front side facing the exposure drum and said hinge is disposed on said front side.

3. The assembly according to claim 1, wherein said exposure-head carrier has a tilting drive with which a rear of said carrier plate facing the exposure drum can be raised or lowered.

4. The assembly according to claim 3, wherein said exposure-head carrier contains:

carrier arms connected to said rear of said carrier plate; and a rotatably driven eccentric shaft connected to said carrier arms and to said rear of said carrier plate through said carrier arms.

5. The assembly according to claim 3, wherein by a tilting movement of said carrier plate, the exposure heads can be moved jointly and substantially radially toward the exposer or away from the exposer.

6. The assembly according to claim 1, wherein said hinge is formed of at least one spring plate.

7. The assembly according to claim 1, wherein the recording material is a printing plate and the exposer is an external drum exposer with an exposure drum for holding the printing plate.

8. An exposer for recording printing originals, the exposer comprising:

an exposure drum for holding a printing plate;

exposure heads for focusing laser beams on the recordinq material; and an exposure-head carrier supporting said exposure heads and setting a focus of said-exposure heads on the printing plate, said exposure-head carrier having a carrier plate holding said exposure heads, a carrier base, and a hinge connecting said carrier plate and said carrier base such that they can move, said hinge having a fixed axis of rotation extending axially along said exposure drum and said hinge permitting a tilting movement of said carrier plate about said axis of rotation.

* * * * *